US011396729B2

(12) United States Patent
Constantine

(10) Patent No.: US 11,396,729 B2
(45) Date of Patent: Jul. 26, 2022

(54) DIRECT FIXATION FASTENER HAVING INTERLOCKING ECCENTRICS FOR LATERAL ADJUSTMENT

(71) Applicant: Progress Rail Services Corporation, Albertville, AL (US)

(72) Inventor: Edward Constantine, Kansas City, MO (US)

(73) Assignee: Progress Rail Services Corporation, Albertville, AL (US)

( * ) Notice: Subject to any disclaimer, the term of this patent is extended or adjusted under 35 U.S.C. 154(b) by 413 days.

(21) Appl. No.: 16/541,913

(22) Filed: Aug. 15, 2019

(65) Prior Publication Data

US 2021/0047785 A1 Feb. 18, 2021

(51) Int. Cl.
*E01B 9/02* (2006.01)

(52) U.S. Cl.
CPC ..... *E01B 9/02* (2013.01)

(58) Field of Classification Search
CPC ..... E01B 9/02; E01B 9/12; E01B 9/14; E01B 9/36; E01B 9/58; E01B 9/60; E01B 9/66
See application file for complete search history.

(56) References Cited

U.S. PATENT DOCUMENTS

| | | | | |
|---|---|---|---|---|
| 3,934,800 | A | 1/1976 | Molyneux | |
| 4,284,114 | A * | 8/1981 | Korenobu | F16B 39/10 411/119 |
| 4,325,510 | A | 4/1982 | Sherrick | |
| 8,413,910 | B2 | 4/2013 | Bösterling et al. | |
| 8,602,317 | B2 * | 12/2013 | Bosterling | E01B 9/38 238/312 |
| 10,081,915 | B2 | 9/2018 | Constantine | |
| 10,240,299 | B2 | 3/2019 | Constantine | |
| 2011/0068184 | A1 * | 3/2011 | Rademacher | E01B 9/42 238/282 |
| 2015/0060561 | A1 * | 3/2015 | Ciloglu | E01B 9/60 238/315 |
| 2019/0218723 | A1 | 7/2019 | Engert | |

FOREIGN PATENT DOCUMENTS

| | | | |
|---|---|---|---|
| CN | 109371764 | A | 2/2019 |
| KR | 100776267 | B1 | 11/2007 |

* cited by examiner

*Primary Examiner* — Robert J McCarry, Jr.
(74) *Attorney, Agent, or Firm* — Brannon Sowers & Cracraft

(57) ABSTRACT

A direct fixation track rail fastener includes a fastener body having a top plate, a frame, and an overmolded jacket. A first and a second lateral positioner are positioned in positioner bores extending through the fastener body, and each includes an eccentric. The eccentrics include axially extending external teeth interlocked with axially extending slots within the positioner bores. In an aspect, the eccentrics are dual eccentrics each including tooth and slot interlocking arrangements with another eccentric or the frame.

16 Claims, 4 Drawing Sheets

DIRECT FIXATION FASTENER HAVING INTERLOCKING ECCENTRICS FOR LATERAL ADJUSTMENT

TECHNICAL FIELD

The present disclosure relates generally to a fastener for track rail, and more particularly to a direct fixation fastener having lateral positioners with eccentrics interlocking with a frame.

BACKGROUND

Rail equipment is used across the world for transportation of persons and all manner of goods and equipment. Rail lines for freight or passenger service, are formed by parallel track rails supported upon a concrete or gravel substrate, for instance, and will be familiar to most. Depending upon the design of the rail line and the type of substrate, a variety of different mechanisms are used for positioning, supporting, and fastening the rails as well as managing loads and vibrations transmitted by way of the rail and fasteners between rail equipment and the underlying substrate.

Rail fastening and fixation systems range from simple plates that attach rails to wooden ties by way of spikes, to highly engineered direct fixation fasteners formed from an assembly of metallic and non-metallic components. One known direct fixation fastener for track rail is set forth in U.S. Pat. No. 10,081,915 to Constantine. The Constantine strategy has various applications, yet the field always welcomes improvements and/or alternative strategies.

Despite advanced construction techniques, a supporting substrate for a rail line, often poured concrete, can vary from specifications. Also, attachment mechanisms that are cast in place within the substrate, typically bolts or structures adapted to receive bolts, pedestal mounts, or others can vary from intended placement or positioning, or potentially even migrate or deform from specifications over time.

SUMMARY OF THE INVENTION

In one aspect, a track rail fastener includes a fastener body having a top plate, a frame, and an overmolded jacket supporting the top plate and the frame in spaced relation to one another. The frame has a first positioner bore and second positioner bore formed therein. The track rail fastener also includes a first lateral positioner and a second lateral positioner including a first eccentric and a second eccentric, respectively. The first eccentric and the second eccentric each define a center axis and have formed therein an axially extending bore offset in relation to the center axis. The frame further includes axially extending slots within each of the first positioner bore and the second positioner bore. The first eccentric and the second eccentric each include axially extending external teeth interlocked with the axially extending internal slots within the first positioner bore and the second positioner bore, respectively.

In another aspect, a direct fixation fastener includes a fastener body having a top plate with an upper rail surface extending in a fore-aft direction, a frame, an overmolded jacket encasing the top plate and the frame, and a positioner bore formed in the fastener body at a location that is lateral to the upper rail surface. The direct fixation fastener also includes a lateral positioner including an eccentric defining a center axis and having formed therein an axially extending bore offset in relation to the center axis and structured to receive an elongate clamping member for clamping the fastener body to a substrate. The direct fixation fastener also includes axially extending internal slots within the positioner bore. The eccentric further includes axially extending external teeth structured to interlock with the axially extending internal slots at a range of angular orientations of the eccentric, relative to the center axis, within the positioner bore.

In still another aspect, a lateral positioning mechanism for a fastener includes a frame having a positioner bore formed therein, and including axially extending internal slots within the positioner bore. The lateral positioning mechanism also includes an outer eccentric defining a first center axis, and having axially extending external teeth interlocked with the axially extending internal slots of the frame, a first axially extending bore that is eccentrically arranged relative to the first center axis, and axially extending internal slots within the axially extending bore. The lateral positioning mechanism still further includes an inner eccentric defining a second center axis, a second axially extending bore that is eccentrically arranged relative to the second center axis, and axially extending external teeth interlocked with the axially extending internal slots of the outer eccentric. The outer eccentric is positioned in the positioner bore, and further includes a first circumferential flange in contact with the frame, and the inner eccentric is positioned in the first axially extending bore, and further includes a second circumferential flange in contact with the outer eccentric.

DETAILED DESCRIPTION

Figure 1:
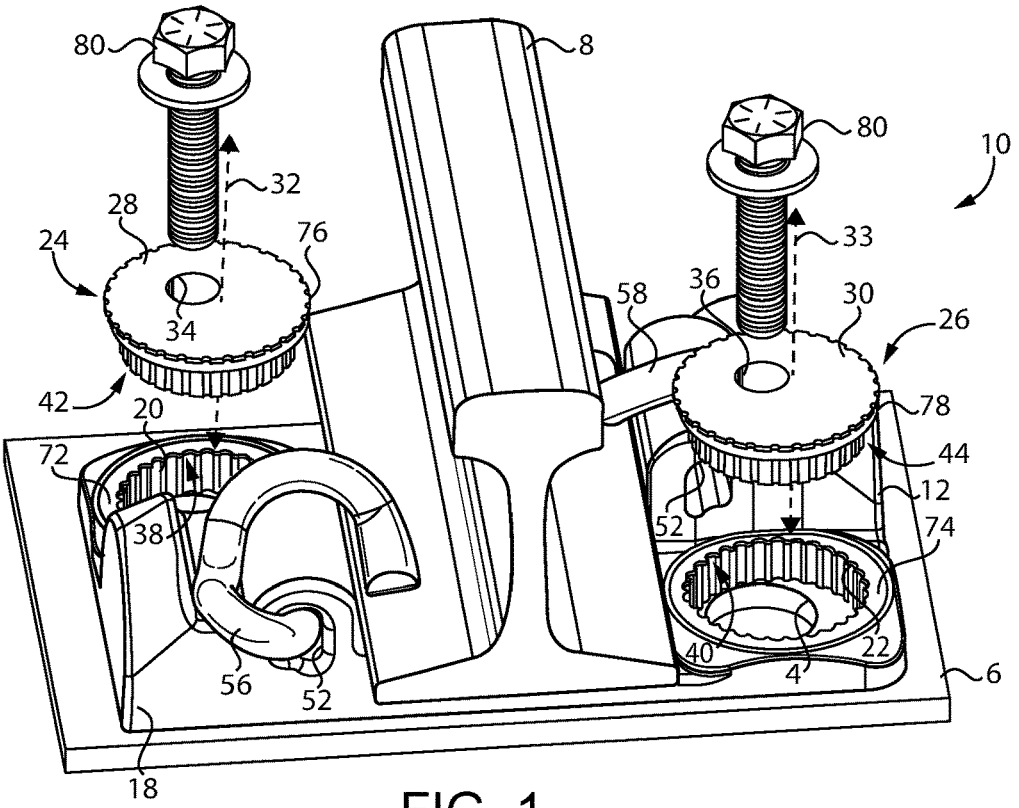
FIG. 1 is a diagrammatic view of a direct fixation track rail fastener, partially disassembled and supporting a track rail, according to one embodiment.
Figure 2:
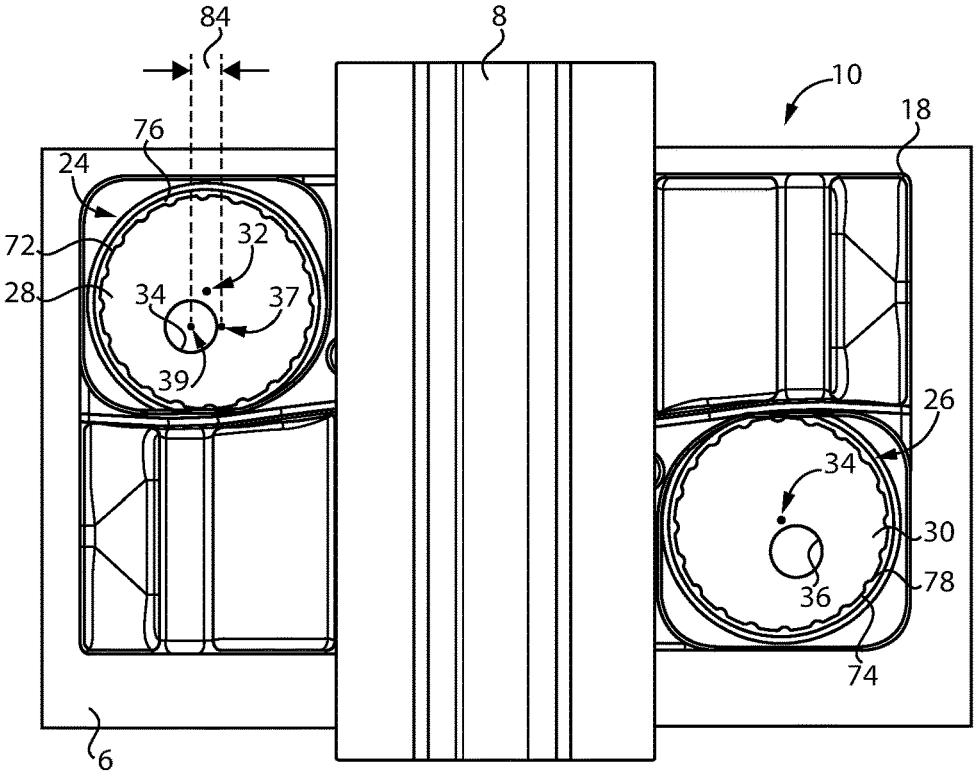
FIG. 2 is an elevational view of the fastener of FIG. 1.
Figure 3:
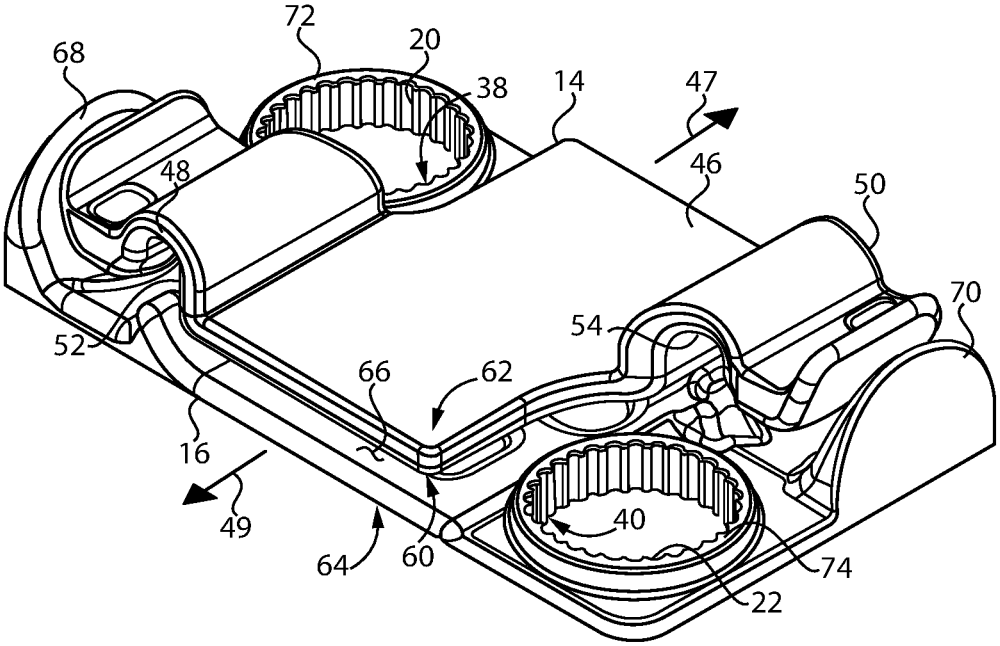
FIG. 3 is a diagrammatic view of internal parts of the fastener of FIGS. 1 and 2.

Referring to FIG. 1, there is shown a direct fixation track rail fastener 10 supporting a section of track rail 8, according to one embodiment. Fastener 10 includes a fastener body 12 that supports track rail 8 upon a shim 6 that can be positioned upon a substrate, such as a poured concrete substrate. In other instances, a shim might not be used. Fastener 10 can be structured to support and clamp track rail 8 by way of a first rail clip or E-clip 56 and a second rail clip or E-clip 58 in a generally conventional manner. Elongate clamping elements in the nature of bolts 80 can be passed through fastener body 12, through bores 4 in shim 6, and coupled with receiving elements (not shown) within the underlying substrate, such as cast in place bolting elements. In other embodiments cast-in-place elements could extend up through fastener body 12 and be coupled with nuts or the like. Referring also to FIGS. 2 and 3, fastener body 12 includes a top plate 14, a frame 16, and an overmolded jacket 18 supporting top plate 14 and frame 16 in spaced relation to one another. Fastener body 12, and in particular frame 16, has a first positioner bore 20 and a second positioner bore 22 formed therein. As shown in FIG. 3, top plate 14 also includes an upper rail surface 46 extending in a fore-aft direction. A fore or forward direction is shown generally by way of arrow 47 in FIG. 3, and a rearward or aft direction is shown by way of arrow 49. Each of top plate 14 and frame 16 can include a one-piece metal body, such as a casting, and may be supported in the spaced relation by way of overmolded jacket 18 such that top plate 14 and frame 16 are not physically in contact with one another. Instead, material of overmolded jacket 18 extends between top plate 14 and frame 16 for purposes of positioning the components, attenuating vibrations, cushioning, resiliently accommodating shear loads and twisting loads, for instance, and providing electrical insulation. Overmolded jacket 18 could be formed from a non-metallic material such as an elastomeric material, natural or synthetic rubber, or a variety of other non-metallic materials. Top plate 14 has a lower surface 60, and frame 16 has an upper surface 62. A clearance 66 may extend between lower surface 60 and upper surface 62. When constructed for service, the material of overmolded jacket 18 can fill clearance 66. Top plate 14 may also include a first shoulder 48 extending in a first outboard direction from upper rail surface 46, a leftward lateral direction on FIG. 3, and a second shoulder 50 extending in a second outboard direction, a right lateral direction in FIG. 3, from upper rail surface 46. Upper rail surface 46 can be free of, or substantially free of, material of overmolded jacket 18. A first rail clip bore 52 and a second rail clip bore 54 receive first E-clip 56 and second E-clip 58, respectively, and are formed between frame 16 and first shoulder 48 and second shoulder 50, respectively. A first end wall 68 of frame 16 extends generally upwardly at a location that is outboard of first shoulder 48. A second end wall 70 of frame 16 extends generally upwardly at a location that is outboard of second shoulder 50. Fastener body 12, and in particular frame 16, further has a first positioner bore 20 and a second positioner bore 22 formed therein, each located laterally of upper rail surface 46. First positioner bore 20 extends vertically through fastener 12 and frame 16 at a location that is forward of first shoulder 48, and second positioner bore 22 extends vertically through fastener body 12 and frame 16 at a location that is aft of second shoulder 50. It can thus be noted that first positioner bore 20 and second positioner bore 22 can be understood to be offset in the fore-aft direction from first shoulder 48 and second shoulder 50, respectively, placing first positioner bore 20 and second positioner bore 22 approximately in a forward left and a right back quadrant, respectively, of fastener body 12. In other embodiments, first positioner bore 20 and second positioner bore 22 could be arranged closer to a fore-aft medial location of fastener body 12. Still other embodiments could include a greater number of positioner bores than two, however, a total of two positioner bores provides a practical implementation strategy.

Fastener 10 further includes a first lateral positioning mechanism or positioner 24 and a second lateral positioning mechanism or positioner 26 structured for positioning within first positioner bore 20 and second positioner bore 22, respectively. First lateral positioner 24 includes a first eccentric 28 defining a first center axis 32. Second lateral positioner 26 includes a second eccentric 30 defining a second center axis 33. Axes 28 and 30 can be geometric center axes of eccentrics 28 and 30. First eccentric 28 and second eccentric 30 have formed therein, respectively, a first axially extending bore 34 and a second axially extending bore 36, offset in relation to the corresponding center axis 32 and 33. In some instances, center axes 32 and 33 could pass through axially extending bores 34 and 36, respectively, and axially extending bores 34 and 36 still understood as offset in relation to the corresponding center axis, so long as the axially extending bores are not centered upon the corresponding center axis. In the illustrated embodiment, center axes 32 and 33 do not extend through the axially extending bores.

With continued reference to FIG. 2, there can be seen in an elevational view, that in first eccentric 28 another axis 39 is generally at a center of axially extending bore 34. Axis 39 represents a location of a center axis that might be observed for a bolt, a nut, or another attachment element that is cast-in-place in an underlying substrate but is offset from an axis location 37 that is specified. In other words, axis 39 might represent an actual axis location offset by an offset distance 84 from a desired or intended axis location 37. Eccentric 28 may be structured for positioning at any of a range of angular orientations about its own center axis 32 to enable axially extending bore 34 to be positioned for accommodating bolts or other structures for attaching fastener 10 to the underlying substrate that are out of specification. During installation or adjustment, eccentric 28 can be rotated about center axis 32 to position axially extending bore 34 appropriately for clamping fastener 10 to the substrate, accommodating errors or tolerances in the structure of the underlying substrate itself, or in locations of cast-in-place components. Adjustments of fastener 10 can also be undertaken in response to factors such as wear of rail 8, to maintain a proper rail gauge over time. This description of the functionality of eccentric 28 also applies to eccentric 30, and generally to other eccentrics in direct fixation track rail fasteners according to the present disclosure.

It can further be noted that frame 16 includes axially extending internal slots 38 within first positioner bore 20, and axially extending internal slots 40 within second positioner bore 22. Axially extending internal slots 38 and 40 may be formed integrally in frame 16, and in the one-piece metal body formed thereby. Axially extending means in a direction parallel to an axis, in this case parallel axes 32 and 33 as the case may be. First eccentric 28 and second eccentric 30 each include axially extending external teeth 32 and 34, respectively, structured to interlock with axially extending internal slots 38 and 40 within first positioner bore 20 and second positioner bore 22, respectively. As used herein the term "teeth" contemplates serrations, flutes, roundings, or other structures that can mate with slots 38 and 40, which are complementarily shaped to teeth 32 and 34. Certain earlier direct fixation fasteners employed eccentrics that were clamped to and/or compressed against an underlying substrate or shim to fix their relative angular orientation about their center axes by way of frictional forces. According to the present disclosure, interlocking of axially extending slots 38 and 40 with axially extending external teeth 42 and 44 enables locking of first eccentric 28 and second eccentric 30 at desired angular orientations without the need for clamping or otherwise directly contacting the eccentrics with the underlying substrate, shim, et cetera. It can further be noted from FIG. 3 and FIG. 4 that frame 16 includes a first clamping surface 72 extending circumferentially around first positioner bore 20, and a second clamping surface 74 extending circumferentially around second positioner bore 22. Clamping surfaces 72 and 74 may be free of, or substantially free of, material of overmolded jacket 18.

Figure 4:
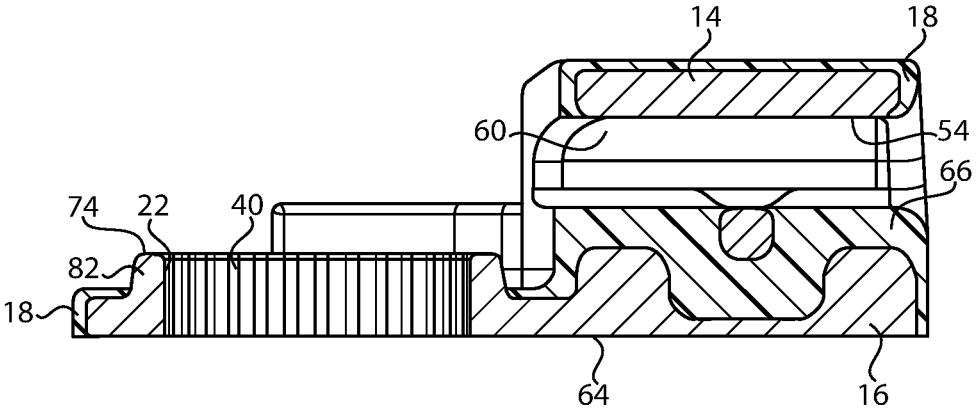
FIG. 4 is a sectioned side diagrammatic view of portions of the fastener of FIGS. 1 and 2.

First eccentric 28 also includes a circumferential flange 76 and second eccentric 30 also includes a circumferential flange 78, in contact with the corresponding one of first clamping surface 72 and second clamping surface 74. FIGS. 3 and 4 show an upwardly projecting wall 82 having clamping surface 74 formed thereon. A similar geometry and construction associated with first positioner bore 20 can be seen as well in FIG. 3. The upwardly projecting wall 82 extends circumferentially around second positioner bore 22, and can enable second eccentric 30 to be seated directly upon frame 16, with second eccentric 30 suspended above the substrate. Second eccentric 30 can be formed of a metal material, such that the contact between second eccentric 30 and frame 16 is metal-to-metal contact. First eccentric 28 may be analogously structured to seat It will be recalled that frame 16 and top plate 14 may not be in direct contact with one another, hence, track rail 8, top plate 14, and other components are not in electrical contact with frame 16, nor the underlying substrate. Similar configurations and properties are associated with other embodiments, further discussed below.

Figure 5:
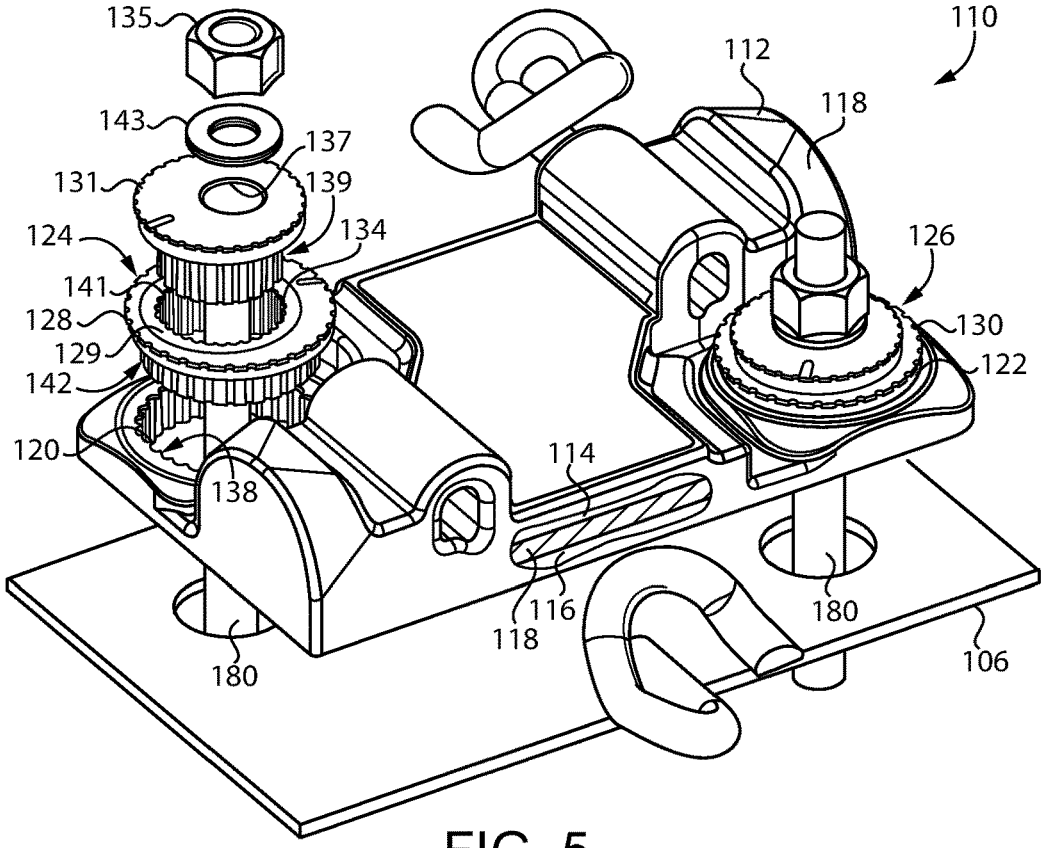
FIG. 5 is a diagrammatic view of a direct fixation track rail fastener, partially disassembled, according to another embodiment.

Referring now to FIG. 5, there is shown a track rail fastener 110 according to another embodiment, and including a fastener body 112 having a top plate 114, a frame 116, and an overmolded jacket 118 supporting top plate 114 and frame 116 in spaced relation to one another. Fastener body 112, and frame 116 in particular, has a first positioner bore 120 and a second positioner bore 122 formed therein. A first lateral positioner 124 and a second lateral positioner 126 include a first eccentric 128 and a second eccentric 130, respectively. First eccentric 128 and second eccentric 130 have formed therein an axially extending bore 134 and 136, respectively, in a manner generally analogous to that described in connection with the foregoing embodiment. Frame 116 further includes axially extending internal slots 138 and 140 within each of first positioner bore 120 and second positioner bore 122, respectively. In FIG. 5, first lateral positioner 124 is shown disassembled, and second lateral positioner 126 is shown assembled. It should be understood that first lateral positioner 124 and second lateral positioner 126 may be substantially identical, and therefore the description of first lateral positioner 124 herein should be understood to refer generally to second lateral positioner 126.

In the foregoing embodiment of track rail fastener 10, each of first eccentric 28 and second eccentric 30 is one-piece. Track rail fastener 110 differs from track rail fastener 10 in that first eccentric 128 includes an outer eccentric 129 and an inner eccentric 131. Second eccentric 130 is analogously configured. Inner eccentric 131 is positioned within axially extending bore 134 in the corresponding outer eccentric 129. Track rail fastener 110 also differs from fastener 10 in that rather than a bolt that is passed vertically downward through the fastener, in track rail fastener 110 bolts or the like 180 may be cast-in-place in the underlying substrate, or in a preformed plinth, for example, and extend vertically upward through a shim 106, to be coupled with nuts 135 that are tightened down to clamp first lateral positioner 124 and second lateral positioner 126, along with fastener body 112, to the underlying substrate, or to shim 106 where used.

It will be recalled that frame 116 further includes axially extending internal slots 138, formed substantially similar to axially extending internal slots 38 in frame 16 of fastener 10. Outer eccentric 129 further includes axially extending external teeth 142 interlocked with the axially extending internal slots 138 within first positioner bore 120. Inner eccentric 131 can include a plurality of axially extending external teeth 139 that are interlocked with axially extending internal slots 141 formed within axially extending bore 134 in outer eccentric 129.

Figure 6:
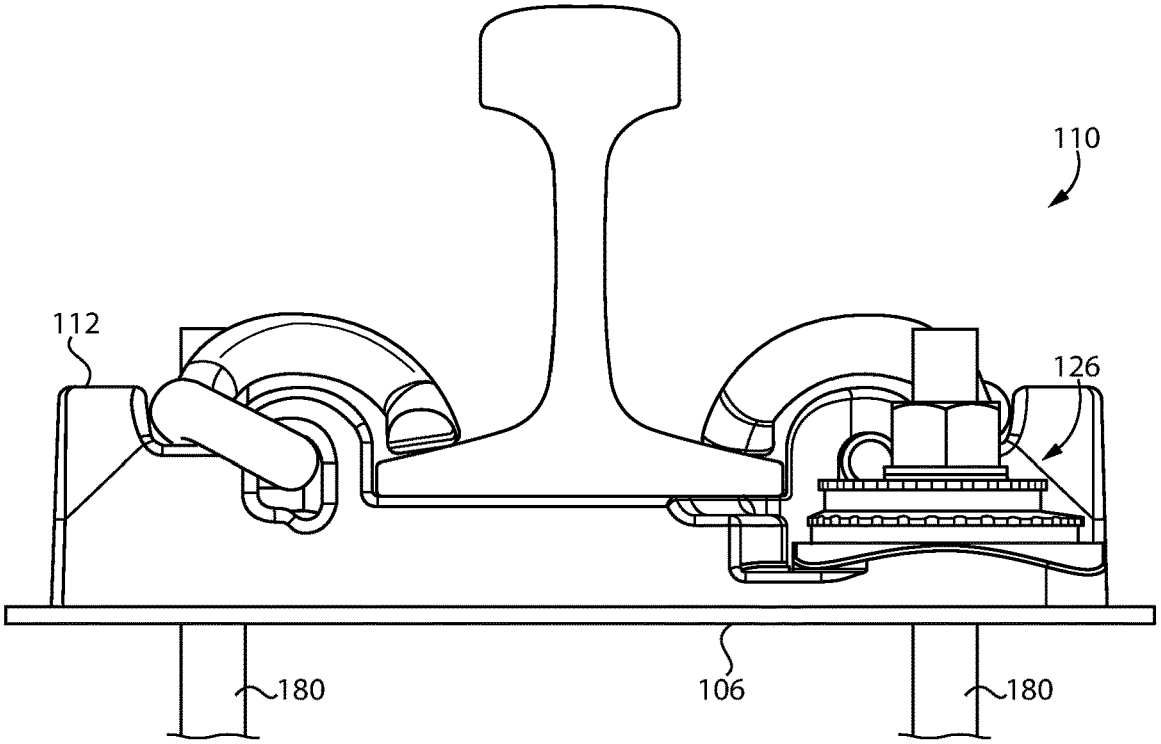
FIG. 6 is a diagrammatic end view of the fastener of FIG. 5 supporting a track rail.
Figure 7:
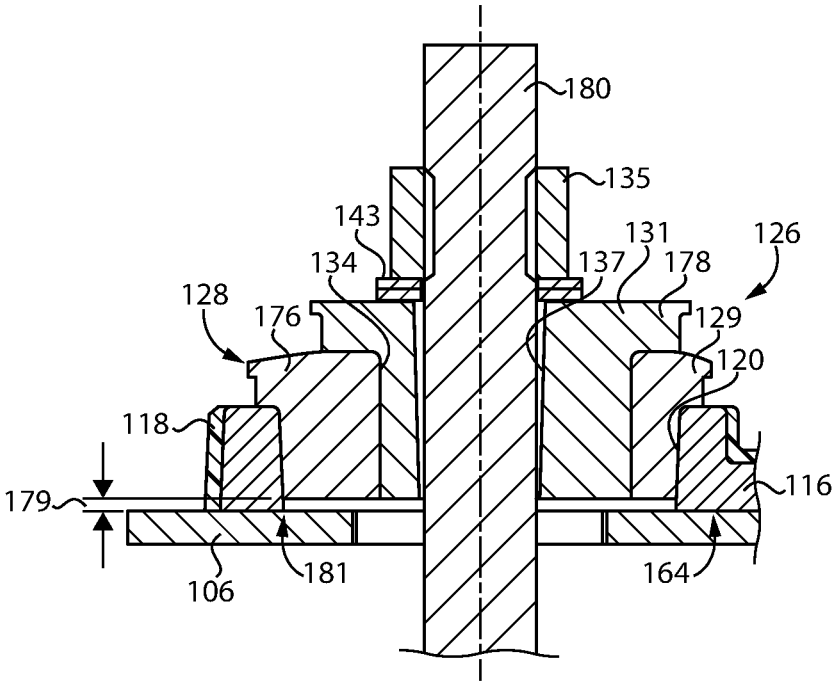
FIG. 7 is a sectioned side diagrammatic view through a portion of the fastener of FIGS. 5 and 6.
Figure 8:
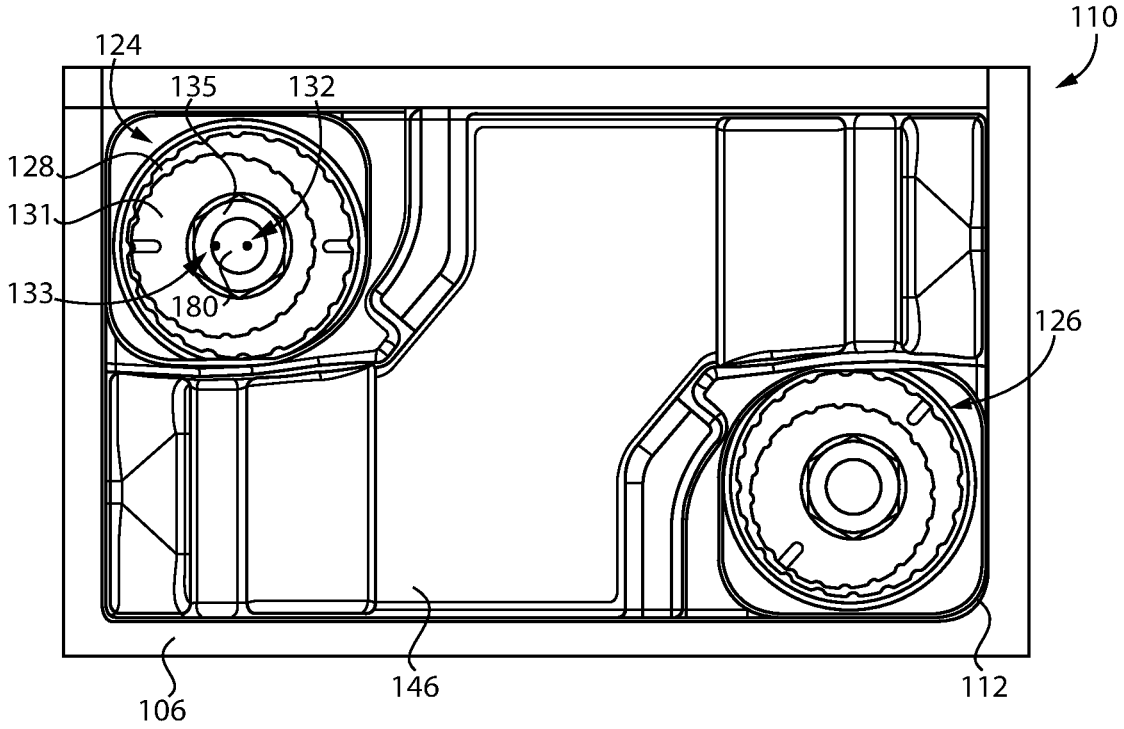
FIG. 8 is an elevational view of the fastener of FIGS. 5-7.

Referring also to FIGS. 6 and 7, there can be seen additional details of the structure and manner by which fastener 110 is clamped to shim 106 and/or the underlying substrate. A nut 135 can be threaded onto elongate clamping element or bolt 180, with a washer or the like 143 clamped between nut 135 and inner eccentric 131. Inner eccentric 131 includes a circumferential flange 178 that is in contact with and clamped upon outer eccentric 129. Outer eccentric 129 also includes a circumferential flange 134 that is in contact with and clamped upon frame 116. It will be recalled from the foregoing discussion of fastener 10 that an eccentric in the present disclosure may not be clamped into contact with the underlying substrate or a shim, but instead is clamped directly to the frame of the fastener. As can be seen in FIG. 7, a clearance 179 extends between each of outer eccentric 129 and inner eccentric 131 and shim 106. The bottom surface of frame 116 may be planar and understood to define a mounting plane, and each of first eccentric 128 and second eccentric 130, including each of outer eccentric 129 and inner eccentric 131 as shown in FIG. 7, is recessed from the planar lower surface of frame 116 such that clearance 179 extends vertically between the mounting plane and each of outer eccentric 129 and inner eccentric 130. It can thus be understood that a clamping load is transmitted from nut 135 to washer 143, to inner eccentric 131, and by way of circumferential flange 178, to outer eccentric 129, and by way of circumferential flange 176 to frame 116. The clamping load clamps frame 116 directly to shim 106, or to the underlying substrate directly if frame 116 is rested directly thereon. Outer eccentric 129 contacts frame 116 at a metal-to-metal interface 181. Fastener 110 may be constructed generally analogously to fastener 10, such that top plate 114 is electrically insulated by way of material of overmolded jacket 118 from frame 116. FIG. 8 illustrates an elevational view of fastener 110, where it can be seen that a center axis 132 defined by outer eccentric 129 is offset from a center axis 133 defined by inner eccentric 131. An upper rail surface 146 is also visible in FIG. 8.

INDUSTRIAL APPLICABILITY

Referring to the drawings generally, as explained above variability in construction practices, changes in response to environmental or wear conditions over time, or other factors can justify varying a lateral position of a track rail fastener. In the case of the embodiment of FIGS. 1-4, a technician can loosen elongate clamping members 80, lift one or both of eccentrics 28 and 30 out of positioner bores 20 and 22, and rotate one or both of eccentrics 28 and 30, to reposition axially extending bores 34 and 36, and then reinstall eccentrics 28 and 30. Some adjustments could be achieved by repositioning only one of eccentrics 28 and 30. If fastener 10 is to be shifted laterally in one direction or the other, it will typically be necessary to reposition each of eccentrics 28 and 30. It has been observed that in some instances there can be some minor forward or aft repositioning of the fastener where both eccentrics are rotated, as the relative fore-aft position of axially extending bores 34 and 36 will change as bores 34 and 36 are rotated about center axes 32 and 33. In the case of the embodiments of FIGS. 5-8, the use of dual eccentrics can allow the relative fore-aft locations of the axially extending bores 137 to be maintained. In other words, by rotating each of inner eccentric 131 and outer eccentric 129, in each of lateral positioners 124 and 126, in different directions, the interface with elongate clamping members 180 can be maintained at a constant fore-aft location, and it is therefore not necessary to shift fastener 110 forward or rearward at all.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having" or the like are intended to be open-ended terms. Further, the phrase "based on" is intended to mean "based, at least in part, on" unless explicitly stated otherwise.

What is claimed is:

1. A track rail fastener comprising:

a fastener body including a top plate, a frame, and an overmolded jacket supporting the top plate and the frame in spaced relation to one another, and the frame having a first positioner bore and a second positioner bore formed therein;

a first lateral positioner and a second lateral positioner including a first eccentric and a second eccentric, respectively;

the first eccentric and the second eccentric each defining a center axis and having formed therein an axially extending bore offset in relation to the center axis;

the frame further including axially extending internal slots within each of the first positioner bore and the second positioner bore; and the first eccentric and the second eccentric each including axially extending external teeth interlocked with the axially extending internal slots within the first positioner bore and the second positioner bore, respectively, wherein each of the first eccentric and the second eccentric includes an outer eccentric, and an inner eccentric positioned within the corresponding outer eccentric.

2. The track rail fastener of claim 1 wherein:

the top plate further includes an upper rail surface extending in a fore-aft direction, a first shoulder extending in a first outboard direction from the upper rail surface, and a second shoulder extending in a second outboard direction from the upper rail surface; and a first rail clip bore and a second rail clip bore are formed between the frame and the first shoulder and the second shoulder, respectively.

3. The track rail fastener of claim 2 wherein the first positioner bore extends vertically through the frame at a location that is forward of the first shoulder, and the second positioner bore extends vertically through the frame at a location that is aft of the second shoulder.

4. The track rail fastener of claim 1 wherein:

the frame includes a first clamping surface extending circumferentially around the first positioner bore, and a second clamping surface extending circumferentially around the second positioner bore; and the first eccentric and the second eccentric each include a circumferential flange in contact with the corresponding one of the first clamping surface and the second clamping surface.

5. The track rail fastener of claim 4 wherein the frame includes a one-piece metal body, and the axially extending external teeth of each of the first eccentric and the second eccentric are interlocked with the corresponding axially extending internal slots of the frame at a metal-to-metal interface.

6. The track rail fastener of claim 4 wherein the frame includes a lower surface defining a mounting plane, and each of the first eccentric and the second eccentric is recessed from the lower surface such that a vertical clearance extends between the mounting plane and each of the first eccentric and the second eccentric.

7. The track rail fastener of claim 1 wherein each of the first eccentric and the second eccentric is one-piece.

8. The track rail fastener of claim 1 wherein each of the outer eccentrics further includes axially extending internal slots, and each of the inner eccentrics includes axially extending external teeth interlocked with the corresponding axially extending internal slots.

9. A direct fixation fastener comprising:

a fastener body including a top plate having an upper rail surface extending in a fore-aft direction, a frame, an overmolded jacket encasing the top plate and the frame, and a positioner bore formed in the fastener body at a location that is lateral to the upper rail surface;

a lateral positioner including an eccentric defining a center axis and having formed therein an axially extending bore offset in relation to the center axis and structured to receive an elongate clamping member for clamping the fastener body to a substrate;

axially extending internal slots within the positioner bore; and the eccentric further including axially extending external teeth structured to interlock with the axially extending internal slots at a range of angular orientations of the eccentric, relative to the center axis, within the positioner bore, wherein the positioner bore extends vertically through the frame, and the frame includes a clamping surface extending circumferentially around the positioner bore, wherein the frame includes an upwardly projecting wall having the clamping surface formed thereon, and the eccentric includes a circumferential flange in contact with the clamping surface, and wherein the frame includes a lower surface, and the eccentric is recessed from the lower surface.

10. The direct fixation fastener of claim 9 wherein the eccentric includes an outer eccentric, and an inner eccentric positioned within the outer eccentric.

11. The direct fixation fastener of claim 10 wherein the outer eccentric further includes axially extending internal slots, and the inner eccentric further includes axially extending external teeth interlocked with the axially extending internal slots of the outer eccentric.

12. The direct fixation fastener of claim 11 wherein the inner eccentric further includes a circumferential flange in contact with the outer eccentric.

13. The direct fixation fastener of claim 9 wherein the overmolded jacket extends between the top plate and the frame and electrically insulates the top plate from the frame.

14. The direct fixation fastener of claim 9 wherein the frame includes a one-piece metal body and the axially extending internal slots are formed integrally in the one-piece metal body, and wherein the axially extending external teeth are interlocked with the corresponding axially extending internal slots of the frame at a metal-to-metal interface.

15. A lateral positioning mechanism for a fastener comprising:

a frame having a positioner bore formed therein, and including axially extending internal slots within the positioner bore;

an outer eccentric defining a first center axis, and including axially extending external teeth interlocked with the axially extending internal slots of the frame, a first axially extending bore that is eccentrically arranged relative to the first center axis, and axially extending internal slots within the first axially extending bore;

an inner eccentric defining a second center axis, a second axially extending bore that is eccentrically arranged relative to the second center axis, and axially extending external teeth interlocked with the axially extending internal slots of the outer eccentric;

the outer eccentric being positioned in the positioner bore, and further including a first circumferential flange in contact with the frame; and the inner eccentric being positioned in the first axially extending bore, and further including a second circumferential flange in contact with the outer eccentric.

16. The lateral positioning mechanism of claim 15 wherein the frame includes an upper side, and a lower side forming a mounting surface, and wherein the outer eccentric and the inner eccentric are supported in the positioner bore at locations recessed from the mounting surface.

* * * * *